US012808285B2

(12) United States Patent
Katterbauer et al.

(10) Patent No.: US 12,808,285 B2
(45) Date of Patent: Nov. 24, 2026

(54) METHODS AND SYSTEMS FOR A SMART INFLOW CONTROL VALVE CONTROL UTILIZING WIRELESS SUBSURFACE SENSORS

(71) Applicant: SAUDI ARABIAN OIL COMPANY, Dhahran (SA)

(72) Inventors: Klemens Katterbauer, Dhahran (SA); Abdallah A. Alshehri, Dhahran (SA); Abdulaziz S. Al-Qasim, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 519 days.

(21) Appl. No.: 18/185,997

(22) Filed: Mar. 17, 2023

(65) Prior Publication Data

US 2024/0309737 A1 Sep. 19, 2024

(51) Int. Cl.
*E21B 43/00* (2006.01)
*E21B 43/12* (2006.01)
*E21B 47/12* (2012.01)

(52) U.S. Cl.
CPC ..... *E21B 43/12* (2013.01); *E21B 47/12* (2013.01)

(58) Field of Classification Search
CPC ..... E21B 43/12; E21B 47/12
See application file for complete search history.

(56) References Cited

U.S. PATENT DOCUMENTS 10,810,330 B2 10/2020 Early et al.
11,326,423 B2 5/2022 Alanazi et al.
2002/0180613 A1* 12/2002 Shi ..... E21B 47/18 340/853.1

(Continued)

FOREIGN PATENT DOCUMENTS

WO 2017/059152 A1 4/2017
WO 2021/091562 A1 5/2021

OTHER PUBLICATIONS

Leemhuis, A.P. et al., "Gas Coning Control for Smart Wells"; Proceedings of the SPE Annual Technical Conference and Exhibition; Paper No. SPE-110317-MS; pp. 1-8; Nov. 11, 2017 (8 pages).

(Continued)

*Primary Examiner* — Julio C. Gonzalez
(74) *Attorney, Agent, or Firm* — Osha Bergman Watanabe & Burton LLP

(57) ABSTRACT

A tubing string is disposed within a wellbore to be in fluid communication with a reservoir. One or more inflow control devices are provided in the tubing string to receive well fluids produced from the reservoir. The one or more inflow control devices include a chamber in fluid communion with the tubing string. An inflow control valve is disposed in the chamber. The inflow control valve is configured to regulate a flow of the well fluids entering the tubing string based on a ratio of hydrocarbons to water. A control system is coupled to the inflow control valve. A plurality of sensors is on the tubing string and in communication with the control system to measure well data within the wellbore. The control system receives the well data to create commands to adjust a valve state of the inflow control valve corresponding with a required production rate of a well.

18 Claims, 9 Drawing Sheets

(56) References Cited

U.S. PATENT DOCUMENTS

| | | | | |
|---|---|---|---|---|
| 2015/0345283 | A1* | 12/2015 | Switzer | E21B 47/12 73/152.54 |
| 2020/0362697 | A1* | 11/2020 | Alanazi | E21B 43/12 |
| 2021/0396731 | A1* | 12/2021 | Ahmed | G01N 1/18 |
| 2022/0298917 | A1 | 9/2022 | Ramsay et al. | |

OTHER PUBLICATIONS

Brouwer, D.R. et al., "Dynamic Optimization of Water Flooding with Smart Wells Using Optimal Control Theory"; Proceedings of the European Petroleum Conference; Paper No. SPE-78278-MS; pp. 1-14; Oct. 29, 2022 (14 pages).

Aakre, Haavard et al., "Smart Well With Autonomous Inflow Control Valve Technology"; Proceedings of the SPE Middle East Oil and Gas Show and Conference; Paper No. SPE-164348-MS; pp. 1-8; Mar. 10, 2023 (8 pages).

Cullick, A.S. et al., "Smart Operations With Intelligent Well Systems"; Proceedings of the SPE Intelligent Energy Conference and Exhibition; Paper No. SPE-126246-MS; pp. 1-17; Mar. 23, 2010 (17 pages).

Al-Arnaout, Ibrahim H. et al., "Smart Wells Experiences and Best Practices at Haradh Increment-III, Ghawar Field"; Proceedings of the SPE Middle East Oil and Gas Show and Conference; Paper No. SPE-105618-MS; pp. 1-6; Mar. 11, 2007 (6 pages).

* cited by examiner

METHODS AND SYSTEMS FOR A SMART INFLOW CONTROL VALVE CONTROL UTILIZING WIRELESS SUBSURFACE SENSORS

BACKGROUND

In the oil and gas industry, operations may be performed in a well at various depths below the surface with downhole tools. For example, Fluids are typically produced from a reservoir in a formation by drilling a wellbore into the formation, establishing a flow path between the reservoir and the wellbore, and conveying the fluids from the reservoir to the surface through the wellbore. Typically, a production tubing is disposed in the wellbore to carry the fluids to the surface. The produced fluids may include hydrocarbons (e.g., oil and/or gas) and water. As the produced fluids may contain water, a ratio of hydrocarbons (e.g., oil and/or gas) to water may vary throughout the lifetime of the well. Therefore, it is advantageous to restrict or otherwise limit an influx of fluid flow into the wellbore when the water fraction is high and resume a higher or unrestricted flow when the water fraction reduces. For example, to enhance oil recovery and reduce water production, inflow control valves (ICV) may be provided in the production tubing to regulate a flow of well fluids entering the production tubing based on a ratio of hydrocarbons (e.g., oil and/or gas) to water. The ICVs prevent an influx of water entering the production tubing such that the well fluids produced to the surface contain a predetermined volume of hydrocarbons.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system that may include a tubing string disposed within a wellbore to be in fluid communication with a reservoir; one or more inflow control devices provided in the tubing string to receive well fluids produced from the reservoir, the one or more inflow control devices comprises a chamber in fluid communication with the tubing string; an inflow control valve disposed in the chamber of the one or more inflow control devices, the inflow control valve is configured to regulate a flow of the well fluids entering the tubing string based on a ratio of hydrocarbons to water; a control system coupled to the inflow control valve; and a plurality of sensors on the tubing string and in communication with the control system, the plurality of sensors measure well data within the wellbore. The control system receives the well data to create commands to adjust a valve state of the inflow control valve corresponding with a required production rate of a well.

In another aspect, embodiments disclosed herein relate to a method that may include placing a well in a production mode to produce fluids from a reservoir; uploading well data of the well to a control system from sensors in the well, the sensors being configured to measure well data; correlating, with the control system, upstream data and downstream data, relative to an inflow control valve within the well, to the well data; determining, with the control system, a valve state of the inflow control valve that corresponds to a required production rate of the well based systematically interpolating the well data; and automatically adjusting, with a controller coupled to the control system, the inflow control valve to a required valve state associated with the required production rate in real-time.

In yet another aspect, embodiments disclosed herein relate to a non-transitory computer readable medium storing instructions on a memory coupled to a processor. The instructions may include functionality for optimizing well data transmission between sensors within a well; obtaining the well data; determining a valve state of an inflow control valve that corresponds to a required production rate of the well based systematically interpolating the optimized well data; and automatically adjusting the valve state to match a required valve state associated with the required production rate in real-time.

Other aspects and advantages of the invention will be apparent from the following description and the appended claims.

BRIEF DESCRIPTION OF DRAWINGS

The following is a description of the figures in the accompanying drawings. In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, shapes of the elements as drawn are not necessarily intended to convey any information regarding the actual shape of the elements and have been solely selected for ease of recognition in the drawing.

DETAILED DESCRIPTION

Figure 1:
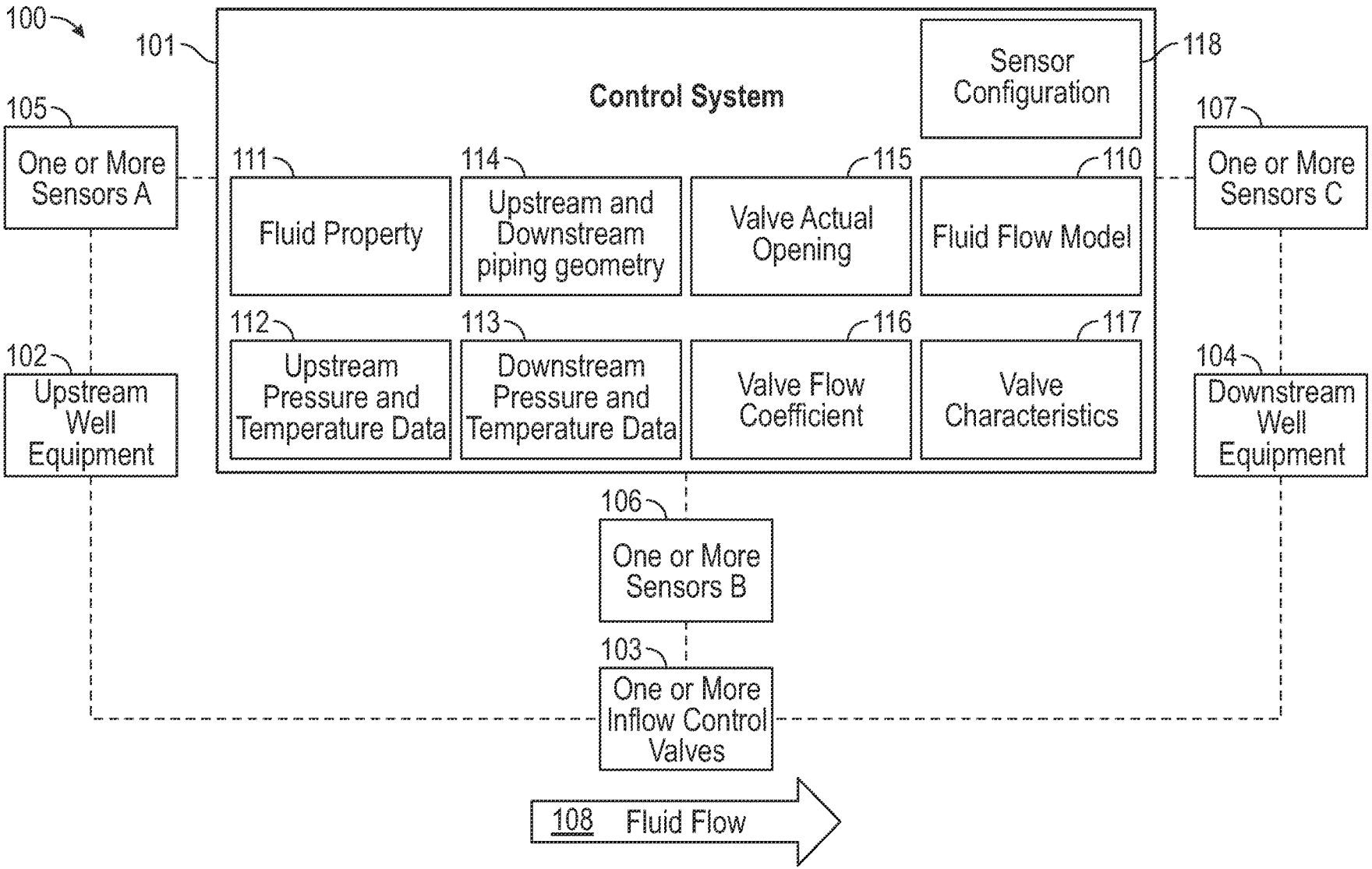
FIG. 1 illustrates a block diagram of a virtual actuation measuring system according to one or more embodiments of the present disclosure.

In the following detailed description of embodiments disclosed herein, numerous specific details are set forth in order to provide a more thorough understanding disclosed herein. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers does not imply or create a particular ordering of the elements or limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-8, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a horizontal beam" includes reference to one or more of such beams.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Further, embodiments disclosed herein are described with terms designating a rig site in reference to a land rig, but any terms designating rig type should not be deemed to limit the scope of the disclosure. For example, embodiments of the disclosure may be used on an offshore rig and various rig sites, such as land/drilling rig and drilling vessel. It is to be further understood that the various embodiments described herein may be used in various stages of a well, such as rig site preparation, drilling, completion, abandonment etc., and in other environments, such as work-over rigs, fracking installation, well-testing installation, and oil and gas production installation, without departing from the scope of the present disclosure. The embodiments are described merely as examples of useful applications, which are not limited to any specific details of the embodiments herein.

In one or more embodiments, the present disclosure may be directed to systems and methods to autonomously control inflow control valves (ICVs) within a well to maximize reservoir production and injection, carbon dioxide (CO2) storage and CO2 plume geothermal (CPG) systems, and hydrogen storage and production using virtual sensing. Rather than using purely hardware devices to control the ICVs, soft measurement logic may be used to extract, analyze, and optimize data from sensors in communication with a well to automatically control the ICVs. In some embodiments, for example, a virtual actuation measuring system determines various well parameters based on data received from the sensors measuring various well parameters such as temperature, pressure, fluid composition, flowrates, and various other downhole or surface well parameters. For example, the virtual actuation measuring system may optimize sensor data transfer and acquisition, via optimizing wireless data transmission between the various sensors. Additionally, the virtual actuation measuring system optimizes the data selection from the various sensors and optimizes in real-time the data transmission between the sensors. Furthermore, the virtual actuation measuring system automatically detects whether a sensor delivers faulty measurements in addition to determining the operational status of the sensors. In one or more embodiments, a control system of the virtual actuation measuring system may implement this virtual sensing to smartly regulate the ICVs to enhance production, injection, or storage well operations. The control system optimizes the ICVs (i.e., open, or closed, single or multi-laterals) based on an intended objective over an intended timeframe using the virtual sensing. Thus, the virtual actuation measuring system optimizes well production or injection for hydrocarbon reservoirs, CO2 storage, CO2 injection for geothermal power optimization, and the hydrogen in situ-generation, storage, production, and transportation.

Turning to FIG. 1, FIG. 1 shows a schematic diagram in accordance with one or more embodiments. As shown in FIG. 1, a virtual actuation measuring system 100 may include a control system 101, upstream well equipment 102, one or more inflow control valves (ICVs) 103, downstream well equipment 104, and various sensors (e.g., one or more sensors A 105 in communication with the upstream well equipment 102, one or more sensors B 106 in communication with the one or more ICVs 103, and one or more sensors C 107 in communication with the downstream well equipment 104).

In one or more embodiments, the upstream well equipment 102 and the downstream well equipment 104 may be equipment used in a well orientated relative to a fluid flow 108 flowing through the one or more ICVs 103. Additionally, the one or more ICVs 103 may be a closure element with hardware for opening and closing a conduit connection to maintain the fluid flow 108 and stop unwanted fluids from entering the wellbore. Furthermore, the various sensors (105-107) may be subsurface miniaturized wireless sensors to measure various physical properties within the well, such as temperature, pressure, flowrates, or fluid compositional properties. For example, the various sensors may have a size range of less than a centimeter, such as a few millimeters. The virtual actuation measuring system 100 receives data from the various sensors (105-107) on the fluid flow 108 exiting the upstream process equipment 102 that passes through the one or more ICVs 103 to the downstream process equipment 104.

In some embodiments, the control system 101 in the virtual actuation measuring system 100 includes a fluid flow model 110. In particular, the fluid flow model 110 may describe one or more physical criteria or conditions for determining various properties of the fluid flow 108 to optimize operating the one or more ICVs 103. For example, the fluid flow model 110 may specify various input parameters (e.g., fluid property 111, upstream pressure and temperature data 112, downstream pressure and temperature data 113, upstream and downstream piping geometry 114, a valve actual opening 115, a Valve Flow Coefficient (Cv) 116, valve characteristics 117, and sensor configuration 118) to determine when to actuate the one or more ICVs 103. For example, the fluid property 111 may include molecular weights, density values, expansion factors regarding the compressibility or incompressibility of a fluid flow, etc. In some embodiments, the fluid property 111 may also include gas properties of hydrogen or CO2. The upstream pressure and temperature data 112 may include sensor values taken from the one or more sensors A 105. The downstream pressure and temperature data 113 may include sensor values taken from the one or more sensors C 107. The upstream and downstream piping geometry 114 may include one or more physical pipe dimensions, such as an inside diameter of one or more pipes or a length of pipe, for example. The valve actual opening 115 may describe a particular opening in the one or more ICVs 103, such as a diameter ratio of a restricted valve, a discharge coefficient that may describe the ratio of an actual discharge through the one or more ICVs 103 in relation to the theoretical discharge, an expansion factor, etc. The Cv 116 is a capacity of the one or more ICVs 103 to deliver flow with an available differential pressure (AP) across the one or more ICVs 103. The valve characteristics 117 may include the type of the one or more ICVs 103 being used. The sensor configuration 118 may include a size of the sensor, wireless transmission antenna configuration, the type of the sensor, and other sensor characteristics.

In some embodiments, for example, the fluid flow model 110 corresponds to a flow model that is expressed utilizing a global optimization algorithm optimization framework. Additionally, the control system 101 may optimize sensor data transfer and acquisition, via optimizing the wireless data transmission between the various sensors (105-107). For example, the control system 101 may optimize data selection from the various sensors (105-107) based on a minimization of the number of sensors active, subject to the constraint that the sensors (105-107) can cover the entire reservoir section with their sensing. The control system 101 may optimize in real-time the data transmission between the various sensors (105-107). In some embodiments, data transmission ranges may differ based on the fluid type in the reservoir, with hydrocarbons attenuating more strongly the wireless transmission waves as compared to water and gas. Additionally, the control system 101 may automatically detect whether a sensor (105-107) delivers faulty measurements in addition to determining their operational status based on the fluid flow model 110.

In one or more embodiments, the control system 101 may optimize the one or more ICVs 103 to regulate a flow of the fluid flow 108 entering the downstream process equipment 104. For example, in a production well, the one or more ICVs 103 prevents an influx of water entering the downstream process equipment 104 such that the well fluids produced to the surface contain a predetermined volume of hydrocarbons. In CO2 applications, the one or more ICVs 103 prevents an influx of water entering the downstream process equipment 104 such that a predetermined volume of CO2 is injected into a formation. Overall, the control system 101 may optimize the one or more ICVs 103 (i.e., opened or closed) based on an intended objective over an intended timeframe for a predetermined fluid flow. This allows the control system 101 to be used in the optimization of well production for hydrocarbon reservoirs, the optimization of CO2 storage, the optimization of CO2 injection for geothermal power optimization, and enhancing the hydrogen storage and production.

With respect to the control system 101, the control system 101 may include hardware and/or software that monitors and/or operates equipment, such as at a well site. In particular, the control system 101 may be coupled to well equipment (102-104) and sensors (105-107) to collect data throughout the wellbore of a well. For example, well equipment (102-104) may include various hardware components, such as wellheads, tubing strings, packers, pumps, valves, injection tools, and various other types of hardware components. Examples of sensors (105-107) may include pressure sensors, temperature sensors, torque sensors, rotary switches, weight sensors, position sensors, microswitches, hydrophones, accelerometers, etc. In some embodiments, the control system 101 may include a programmable logic controller that may control valve states, fluid levels, wellbore pressures, warning alarms, pressure releases and/or various hardware components throughout the wellbore. Thus, a programmable logic controller may be a ruggedized computer system with functionality to withstand vibrations, extreme temperatures, wet conditions, and/or dusty conditions, such as those around a completion well or drilling rig. Furthermore, a control system may be a computer system similar to the computer system described in FIG. 8 and the accompanying description.

In one or more embodiments, the control system 101 also includes an advisory system for the selection of the right Monitoring and surveillance (M&S) plan based on the type of the project being conducted. For example, M&S plans for carbon capture and storage (CCS) or CO2 enhanced-oil-recovery (EOR) taking into considerations surface and subsurface conditions and by integrating sensors information, the control system 101 may identify a loophole in the selected M&S, suggest additional actions or sensors, and identify optimization of existing M&S plan or sensors that are considered redundant or repetitive or basically can by replaced by the integration.

In some embodiments, the control system 101 includes a distributed control system (DCS). A distributed control system may be a computer system for managing various processes at a well using multiple control loops. As such, a distributed control system may include various autonomous controllers (such as remote terminal units) positioned at different locations throughout the well to manage operations and monitor processes. Likewise, a distributed control system may include no single centralized computer for managing control loops and other operations. On the other hand, a SCADA system may include a control system that includes functionality for enabling monitoring and issuing of process commands through local control at a well as well as remote control outside the well. With respect to an RTU, an RTU may include hardware and/or software, such as a microprocessor, that connects sensors and/or actuators using network connections to perform various processes in the automation system.

Figure 2:
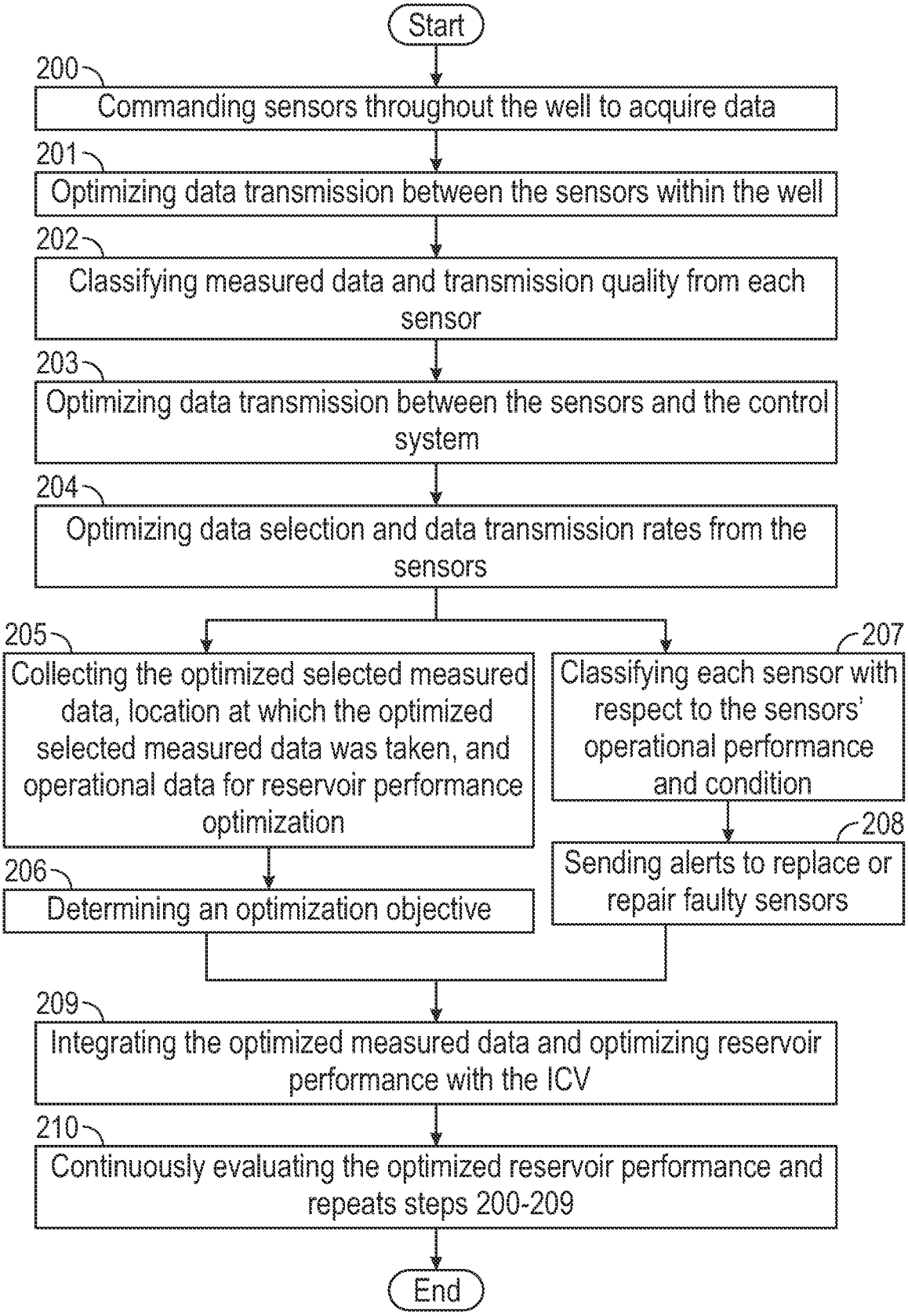
FIG. 2 illustrates an autonomous work process utilized by the virtual actuation measuring system of FIG. 1 according to one or more embodiments of the present disclosure.

Now referring to FIG. 2, an autonomous work process utilized by the virtual actuation measuring system 100 of FIG. 1 is illustrated. For example, a non-transitory computer readable medium may store instructions on a memory coupled to a processor such that the instructions include functionality for operating the one or more ICVs 103 via the control system 101. One or more steps in the autonomous work process of FIG. 2 may be performed by one or more components as described in FIG. 1. While the various steps in FIG. 2 are presented and described sequentially, one of ordinary skill in the art will appreciate that some or all of the steps may be executed in different orders, may be combined or omitted, and some or all of the steps may be executed in parallel. Furthermore, the steps may be performed actively or passively.

In Step 200, the control system commands various sensors throughout the well to acquire data. For example, sensors on a wellhead may measure various pressures, temperatures, flow rates, and fluid properties of a fluid going out (i.e., production) or in (i.e., injection) the wellbore. Additionally, sensors on a tubing string extending in the wellbore may measure various pressures, temperatures, flow rates, and fluid properties of a fluid in a downhole environment both within the tubing string and in annulus between the tubing string and the wellbore. Additional sensors on the tubing string may measure various pressures, temperatures, flow rates, and fluid properties of a fluid exiting or entering reservoirs in communication with wellbore. For example, sensors in communication with the ICVs may measure a volume of water in a fluid entering the tubing string. Furthermore, sensors on a bottom hole assembly (BHA) of the tubing string may measure various pressures, temperatures, flow rates, and fluid properties of a fluid at the bottom of the well and in adjacent reservoirs. In some embodiments, the control system may send commands to the sensors based on a location (i.e., depth) in the well that needs to be measured. It is further envisioned that the control system may send commands for the sensors to turn on from being off or in a standby mode.

In Step 201, the control system optimizes data transmission between sensors within well. For example, the parameters of the sensors that may be optimized by the control system are a delay time, service interval, peak data rate, inactivity interval, jitter, end to end delay throughput, and maximum packet loss within the sensors. The sensors within the well may send and receive data between other sensors via integrated transmitters and receivers.

In Step 202, the control system classifies the measured data and a transmission quality from each sensor. For example, the measured data may be classified according to a signal to noise ratio. The signal to noise ratio may depend on various parameters such as a subsurface fluid, rocks and ICV structure, wireless transmitter, and power and gain. In some embodiments, the control system may cross-correlate the measured data with historical data and/or predetermined thresholds (i.e., maximum and minimum pressures, temperatures, flowrates, and fluid properties) to classify the measured data based on how closely the measured data compares to the historical data and/or predetermined thresholds. Additionally, the transmission quality may be classified based on an amount of data and speed of transmission.

In Step 203, data transmission between the sensors and the control system (i.e., a base station) is optimized. To maximize data transmission, the control system correlates the data transmission to service interval, peak data rate, jitter, end-to-end delay throughput and maximum packet loss, and power requirements of the sensors for optimization. In some embodiments, the measured data by each sensor may be filtered for noise such that the control system receives clean measured data.

In Step 204, data selection from the sensors and data transmission rates are optimized by the control system. For example, the control system may determine the data transmission rate of each sensor to ensure the measured data is transmitted in real-time. Additionally, the control system may adjust the data transmission rate of each sensor to efficiently use power in the sensors. Further, the control system may determine which measured data is selected to minimize measurement uncertainty. For example, the selected measured data may be based on a predetermined value or threshold being met.

In Step 205, the optimized selected measured data, location at which the optimized selected measured data was taken, and operational data is collected by the control system for reservoir performance optimization. For example, the controller system stores the optimized selected measured data, location at which the optimized selected measured data was taken, and operational data to run simulations on reservoir performance.

In Step 206, the control system determines an optimization objective. For example, based on Step 205, the control system calculates how optimization is conducted for improving reservoir performance.

In Step 207, with the optimized data selection and data transmission rates, the control system classifies each sensor with respect to the sensors' operational performance and condition. Each sensor may be classified according to a signal to noise ratio ranging from poor to good. For example, the signal to noise ratio may have a range of 1 to 30 decibels (dB). An optimal signal to noise ratio range may be from 18 to 30 dB. Additionally, the control system may determine a flexible range between 1-30 dB such that a ranking from 1 to 10 corresponds range decibel. For example, a range from 27-30 dB may indicate a 10 which corresponds to a very good sensor data quality. In some embodiments, each sensor may be classified based on accurately and fast the sensors are measuring and transmitting. Additionally, the working condition or health of the sensor may also be used to classify each sensor.

In Step 208, the control system may send alerts to replace or repair faulty sensors. For example, the faulty sensors may be replaced with new sensors depending on how each sensor is classified or have scheduled maintenance to repair the faulty sensors. The control system sends the alert and then the tubing string may be pulled out of hole such that the faulty sensor is exposed at the surface for replacement or repair.

In Step 209, the optimized measured data is integrated into the control system and the reservoir performance is optimized with the ICV. The control system adapted an ICV state of the ICV to optimize the reservoir performance. For example, based on the optimized measured data, the control system adjusts an actuation member in the ICV. This allows the ICV to regulate an influx of water within the fluids flowing through the ICV. For example, in production operations, a portion of the fluid containing water is directed out of the ICV while a remaining portion of the fluid containing mostly hydrocarbons is directed into the tubing string and transported to the surface. From the surface, the well fluids may be transported to a production storage, transport, or facility.

In Step 210, the control system continuously evaluates the optimized reservoir performance and repeats Steps 200-209.

In one or more embodiments, the flowchart of FIG. 2 allows for the control system to autonomously control the ICV to differentiate between fluids in produced well fluids to avoid a water influx in the produced fluids and maintain a sufficient volume of hydrocarbons. Additionally, the flowchart of FIG. 2 allows for the control system to optimize sensor performance in a well.

Figure 3:
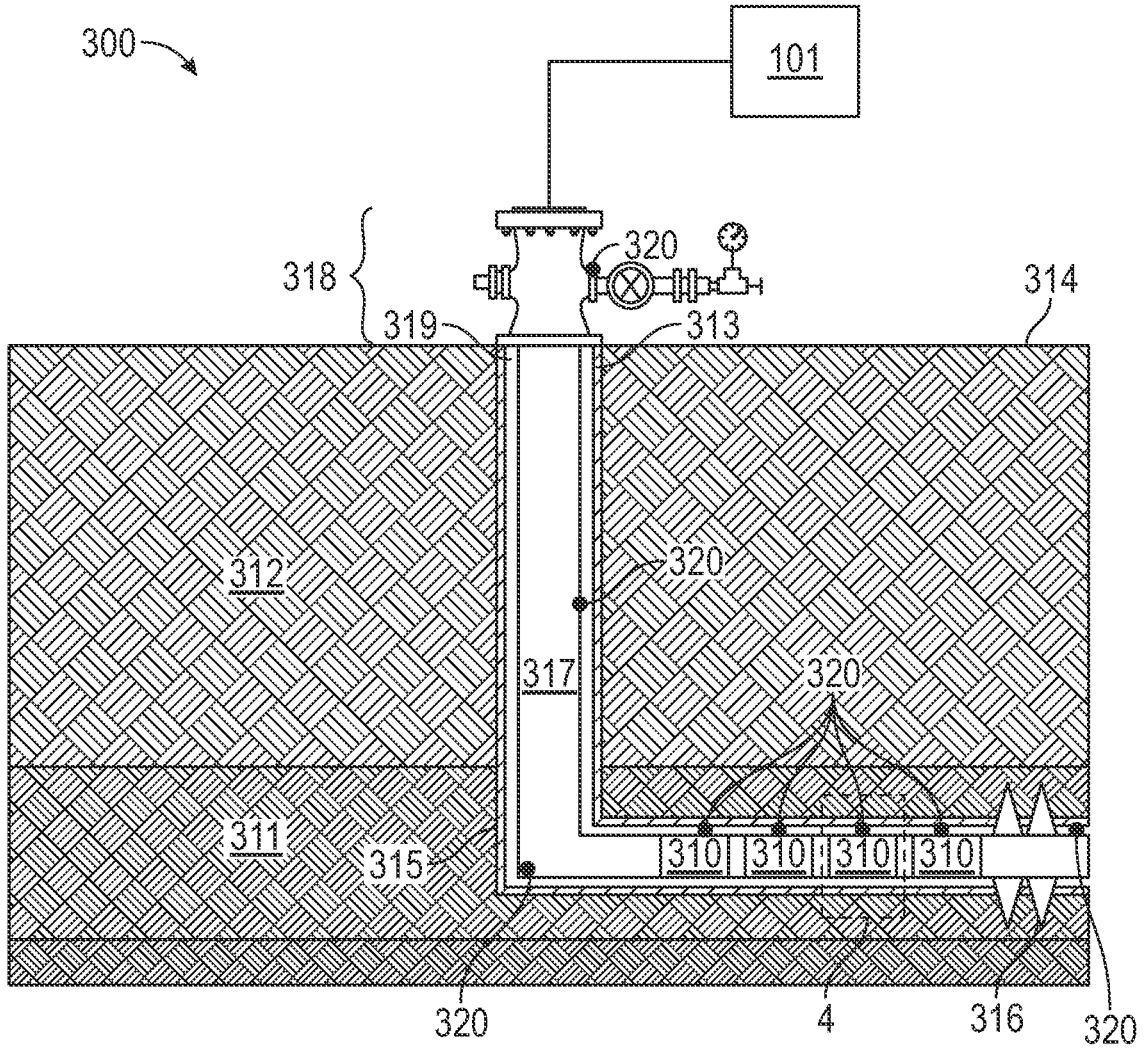
FIG. 3 illustrates a schematic diagram of a completion well system using the virtual actuation measuring system of FIG. 1 according to one or more embodiments of the present disclosure.

Turning to FIG. 3, in one or more embodiments, FIG. 3 shows an example of production operation over the control system 101 of FIG. 1 at a completion well site 300. Well fluids are produced from a reservoir 311 in a formation 312 by drilling a wellbore 313 into the formation 312, establishing a flow path between the reservoir 311 and the wellbore 313, and conveying the fluids from the reservoir 311 to a surface 314 through the wellbore 313. Additionally, the wellbore 313 may include a vertical section to reach the reservoir 311 and a horizontal section extending into the reservoir 311. A casing 315 may be installed in the wellbore 313. In some embodiments, the casing 315 may be perforated to have perforations 316 into the reservoir 311 to allow a flow of the well fluids to enter the wellbore 313. Typically, a production tubing string 317 is disposed in the wellbore 313 to carry the fluids to the surface 314. The production tubing string 317 hangs from a wellhead 318 at the surface 314 and forms an annulus 319 between the production tubing string 317 and the wellbore 313. The production tubing string 317 may extend horizontally into the reservoir 311, thereby forming a flow conduit from the reservoir 311 to the surface 314. From the wellhead 318, the fluids are transported, via a production flow line, to a production storage, transport, or facility. In some embodiments, a Christmas tree may be disposed on top of the wellhead 318 for fluid transportation. In some embodiments, the production tubing string 317 may be an injection tubing string to inject fluids down into the reservoir 311. For example, a fluid source may be coupled to the wellhead 318 and fluids from the fluid source may be injected through the wellhead 318 down the injection tubing string and into the reservoir 311.

As well fluids are produced from the reservoir 311, the well fluids flow into the annulus 319. As the well fluids may contain water, a ratio of hydrocarbons (e.g., oil and/or gas) to water may vary throughout the lifetime of the well. To control an influx of water, one or more inflow control devices 310 may be provided in the production tubing string 317. As the well fluids flow in the annulus 319, the produced well fluids may flow from the annulus 319 and into the production tubing string 317 via the one or more inflow control device 310.

In one or more embodiments, sensors 320 are provided on the well equipment throughout the completion well site 300. For example, sensors 320 may be provided on the wellhead 318 to measure various pressures, temperatures, flow rates, and fluid properties of a fluid going out (i.e., production) or in (i.e., injection) the wellbore 313. Sensors are also provided on the production tubing string 317 to measure various pressures, temperatures, flow rates, and fluid properties of a fluid in a downhole environment both within the production tubing string 317 and in the annulus 319. Additionally, sensors 320 provided on the one or more inflow control devices 310 may measure various pressures, temperatures, flow rates, and fluid properties of a fluid exiting the reservoir 311 and entering the production tubing string 317. For example, the sensors 320 on the one or more inflow control devices 310 may measure a volume of water in a fluid entering the production tubing string 317. Furthermore, sensors 320 provided on the production tubing string 317 approximate the perforations 316 may measure various pressures, temperatures, flow rates, and fluid properties of a fluid at the bottom of the wellbore 313 and the reservoir 311. The sensors 320 may be pressure sensors, temperature sensors, torque sensors, rotary switches, weight sensors, position sensors, microswitches, hydrophones, accelerometers, etc. In some embodiments, the sensors 320 are miniaturized and wireless.

In one or more embodiments, the sensors 320 are in communication with the control system 101 at the surface 314. As described in FIGS. 1 and 2, the sensors 320 record and transmit various physical properties within the well, such as temperature, pressure, flowrates, or fluid compositional properties to the control system 101. Based on the data from the sensors 320, the control system 101 may adjust various downhole operations to optimize the performance of the completion well site 300. For example, each sensor 320 may have an antenna (not shown) to be in communication with the control system 101 to transmit real-time measurements. Further, data acquisition hardware is incorporated into each sensor 320. By obtaining such information, the control system 101 may form a closed loop control and monitoring system without visual inspection and reduce or eliminate human interaction with equipment at the completion well site 300.

Still referring to FIG. 3, in one or more embodiments, the completion well site 300 is placed in a production mode to produce the fluids from the reservoir 311. As the completion well site 300 is in production mode, the control system 101 turns on the sensors 320 to take measurements in the wellbore 313. For example, the sensors 320 may measure various pressures, temperatures, flow rates, and fluid properties of a fluid exiting the reservoir 311 and entering the production tubing string 317 to flow up the surface 314. As the sensors 320 acquire data within the wellbore 313, the sensors 320 also transmit in real-time the data to the control system 101. The control system 101 also optimizes data transmission between the sensors 320. For example, data from sensors 320 at a greater depth in the wellbore 313 is sent first to sensors 320 close to the surface 314 before transmission to the control system 101.

In one or more embodiments, the control system 101 will then classify the measured data from each sensor 320 in the wellbore 313. Additionally, the control system 101 classifies a transmission quality between the sensors 320. For example, the control system 101 may cross-correlate the measured data from the sensors 320 with historical data and/or predetermined thresholds (i.e., maximum and minimum pressures, temperatures, flowrates, and fluid properties) uploaded onto the control system 101. Furthermore, the measured data from each sensor 320 may be filtered for noise such that the control system 101 receives clean measured data.

In some embodiments, the control system 101 also may determine the data transmission rate of each sensor 320 to ensure the measured data is transmitted in real-time. Additionally, the control system 101 may adjust the data transmission rate of each sensor 320 to efficiently use power in the corresponding sensors 320. Further, the control system 101 may determine which measured data is selected to minimize measurement uncertainty. It is further envisioned that the control system 101 classifies each sensor 320 with respect to the sensors' 320 operational performance and condition. The control system 101 also sends alerts to replace faulty sensors with new sensors depending on how each sensor 320 is classified.

Based on the collected data, the control system 101 calculates how optimization is conducted for improving reservoir performance to achieve a determined optimization objective. For example, the control system 101 will determine a required flow rate (e.g., the predetermined production rate) and fluid composition that corresponds to valve state of an inflow control valve (ICV) (103) in the one or more inflow control devices 310. Subsequently, the control system 101 will be able automatically select the required valve state of the ICV (103) associated with a targeted flow rate and fluid composition in real-time. For example, the controller of the control system 101 will command the one or more inflow control devices 310 to actuate the ICV (103) to a valve state per the required targeted flow rate and fluid composition. This allows the ICV (103) to regulate an influx of water within the fluids flowing through the ICV (103).

Figure 4:
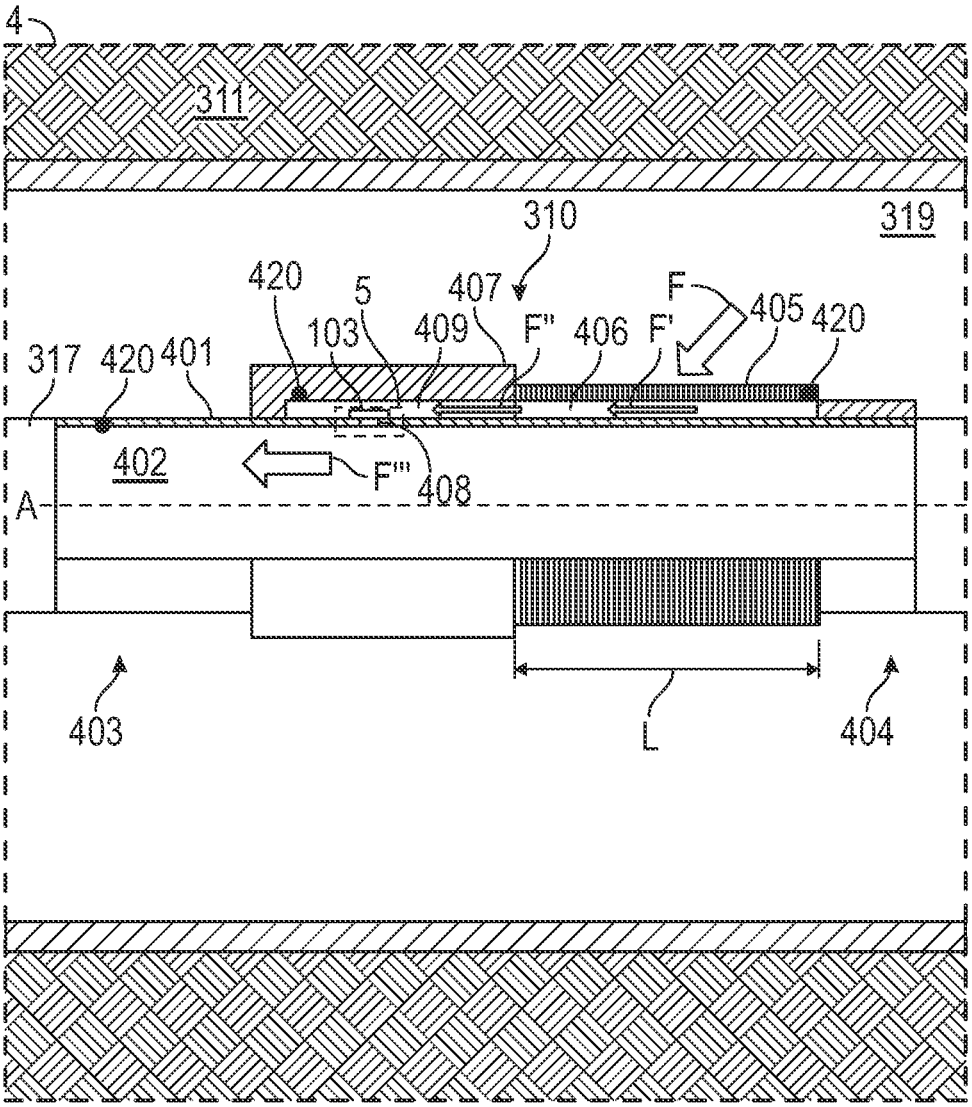
FIG. 4 illustrates an exploded view of the dotted box 4 from FIG. 3 according to one or more embodiments of the present disclosure.

As shown in FIG. 4, a close-up view of the dotted box 4 in FIG. 3 illustrates a cross-sectional view of the produced well fluids flowing into the one or more inflow control devices 310. The one or more inflow control devices 310 includes a body 401 defining a bore 402 extends axially along an axis A from a first end 403 to a second end 404. The first end 403 and the second end 404 may be connection ends to couple the one or more inflow control devices 310 to a production tubing. For example, the first end 403 may be a female threaded connection and the second end 404 may be a male threaded connection to couple to tubulars of a production tubing.

In one or more embodiments, a screen 405 surrounds a length L of the body 401 to form a space 406 between the screen 405 and the body 401. For example, the screen 405 may be a perforated sleeve to filter debris and solids (such as sand) in well fluids entering (see block arrow F) the one or more inflow control devices 310 from the annulus 319. The screen 405 acts as an inlet for the one or more inflow control devices 310 to receive well fluids produced from the reservoir 311. As the screen 405 filters the well fluids, the well fluids flow (see block arrow F') in the space 406.

Adjacent to the screen 405, a housing 407 covers an opening 408 in the body 401 which is fluid communication with the bore 402. Additionally, the housing 407 includes a chamber 409 to receive the well fluids from the space 406. The well fluids flow (see block arrow F") from the space 406 and into the chamber 409. In the chamber 409, the well fluids may enter the bore 402 via the opening 408. Once in the bore 402, the well fluids may proceed to flow (see block arrow F"') out of the one or more inflow control device 310 and into the production tubing string 317 to go up to the surface (314).

In some embodiments, one or more sensors 420 may be provided within the one or more inflow control devices 310. For example, sensors 420 may be provided in communication with the screen 405, the chamber 409, and the bore 402 to measure various fluid properties of well fluids flowing through the one or more inflow control devices 310.

As shown in FIG. 4, The ICV 103 is installed in the opening 408. The ICV 103 regulates a flow of well fluids entering the bore 402 based on a ratio of hydrocarbons (e.g., oil and/or gas) to water. For example, the one or more inflow control device 310 prevents an influx of water entering the bore 402 such that the well fluids produced to the surface (314) contain a predetermined volume of hydrocarbons. As described below, the ICV 103 detects different fluid types in the well fluids and controls a flow based on the detected fluid types.

Figure 5A:
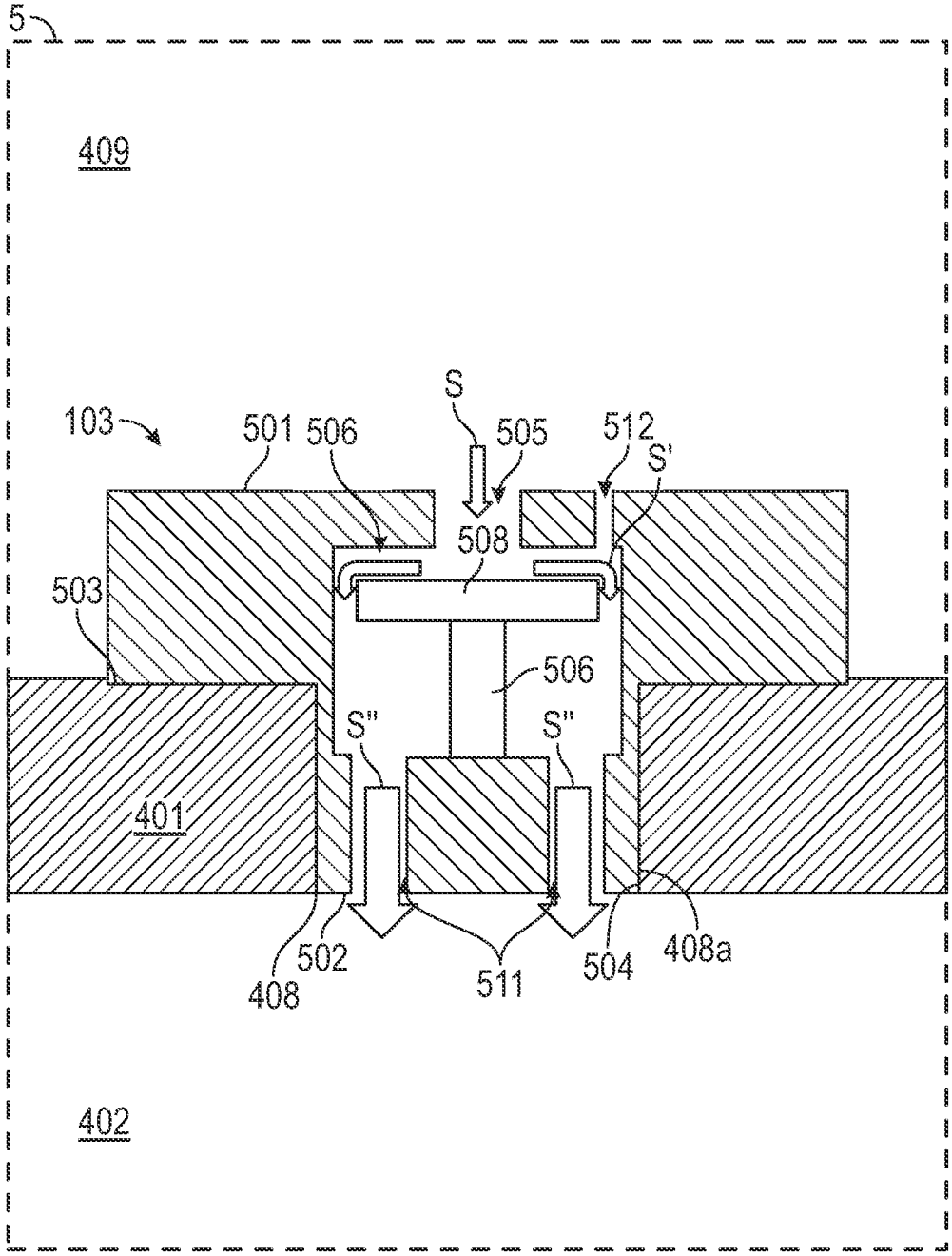
FIGS. 5A and 5B illustrate an exploded view of the dotted box 5 from FIG. 4 according to one or more embodiments of the present disclosure.
Figure 5B:
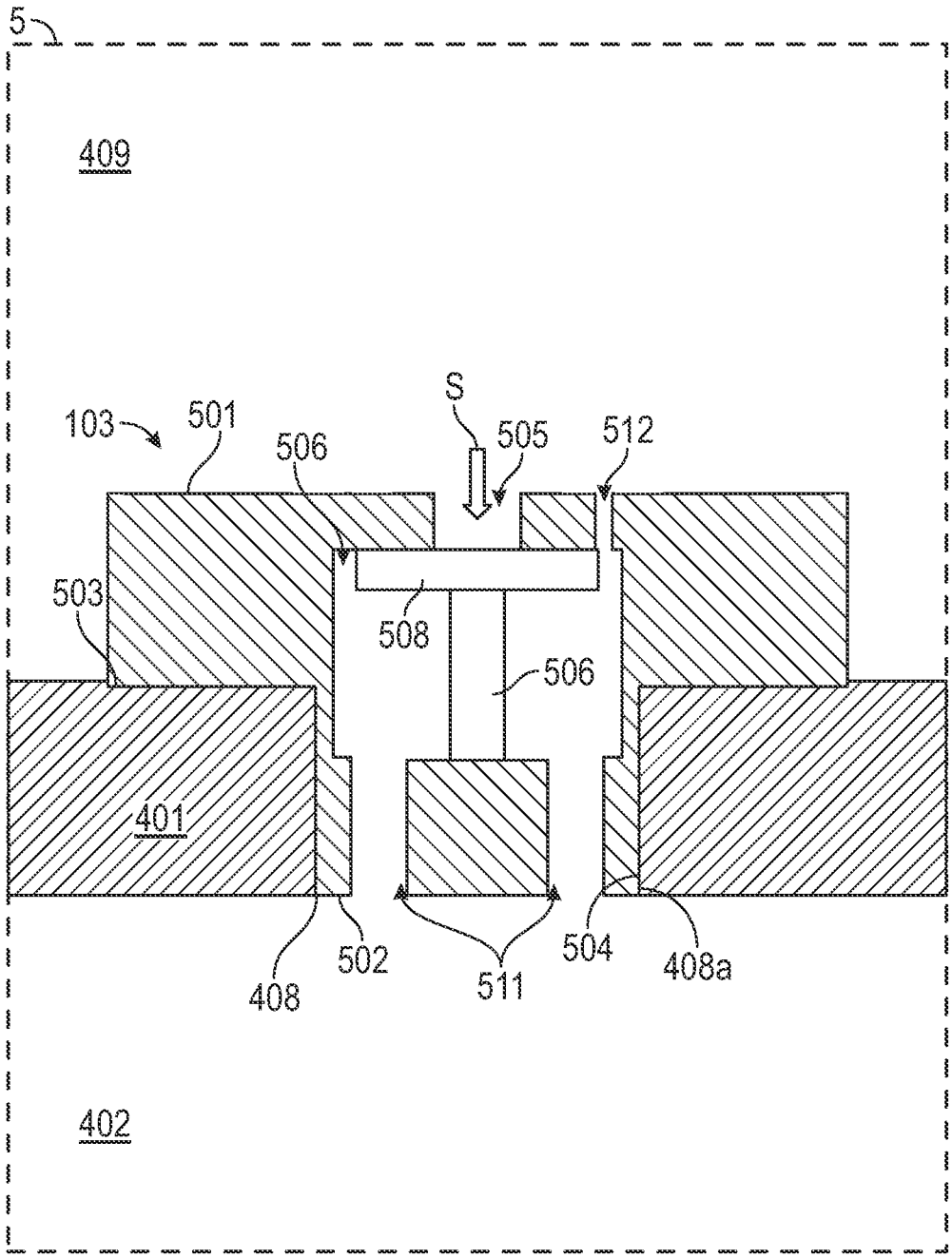

Now referring to FIGS. 5A and 5B, a close-up view of the dotted box 5 in FIG. 4 illustrates a cross-sectional view of the ICV 103 being controlled by the control system (101) according to one or more embodiments. The ICV 103 includes a top portion 501 and a bottom portion 502. The top portion 501 includes a shoulder 503 to land on the body 401. Additionally, the bottom portion 502 includes a connection surface 504 to couple to a wall 408*a* of the body 401 in the opening 408. For example, the connection surface 504 may include threads to be threadedly coupled to threads on the wall 408*a*. The ICV 103 includes an inlet 505 to receive well fluids as a fluid stream (see block arrow S) from the chamber 409. The inlet 505 may be sized to restrict flow and provide a nominally steady fluid velocity to the fluid stream. Additionally, the inlet 505 may also be a mixing chamber such that the fluid stream is mixed to an average density and viscosity of the well fluids. From the inlet 505, the fluid stream is directed into a cavity 506.

In the cavity 506, the fluid stream flows downward and impinges on a disc 508 attached to an actuation member 507. A top surface of the disc 508 causes the fluid stream to deflect (see block arrow S') to flow around the disc 508. As shown in FIG. 5A, the control system (101) actuates the actuation member 507 to move the disc 508 downward and open the inlet 505. In this position, the ICV 103 is an open state allowing flow. From the disc 508, the fluid stream exits (see block arrow S") the cavity 506 via one or more outlets 511. The outlet 511 is in fluid communication with the bore 402 so that the fluid stream flows into the bore 402 from the cavity 506. From the bore 402, the fluid stream may travel up the production tubing string (317).

In one or more embodiments, the fluid stream may be metered or throttled to reduce water influx before the disc 508. For example, a bleed hole 512 may be provided in the top portion 501 to bleed a water influx out of the fluid stream.

Now referring to FIG. 5B, an example of the fluid stream having a water influx is illustrated. In one or more embodiments, the control system (101) may adjust the ICV 103 while in situ without needing to recover the ICV 103 to surface (314). For example, when the fluid property range of the fluid stream does not match the predetermined fluid property range, the control system (101) actuates the actuation member 507 to move the disc 508 upward and close the inlet 505. In this position, the ICV 103 is a closed state blocking flow. In the closed state, the ICV 103 blocks the fluid stream from entering the bore 402.

Figure 6:
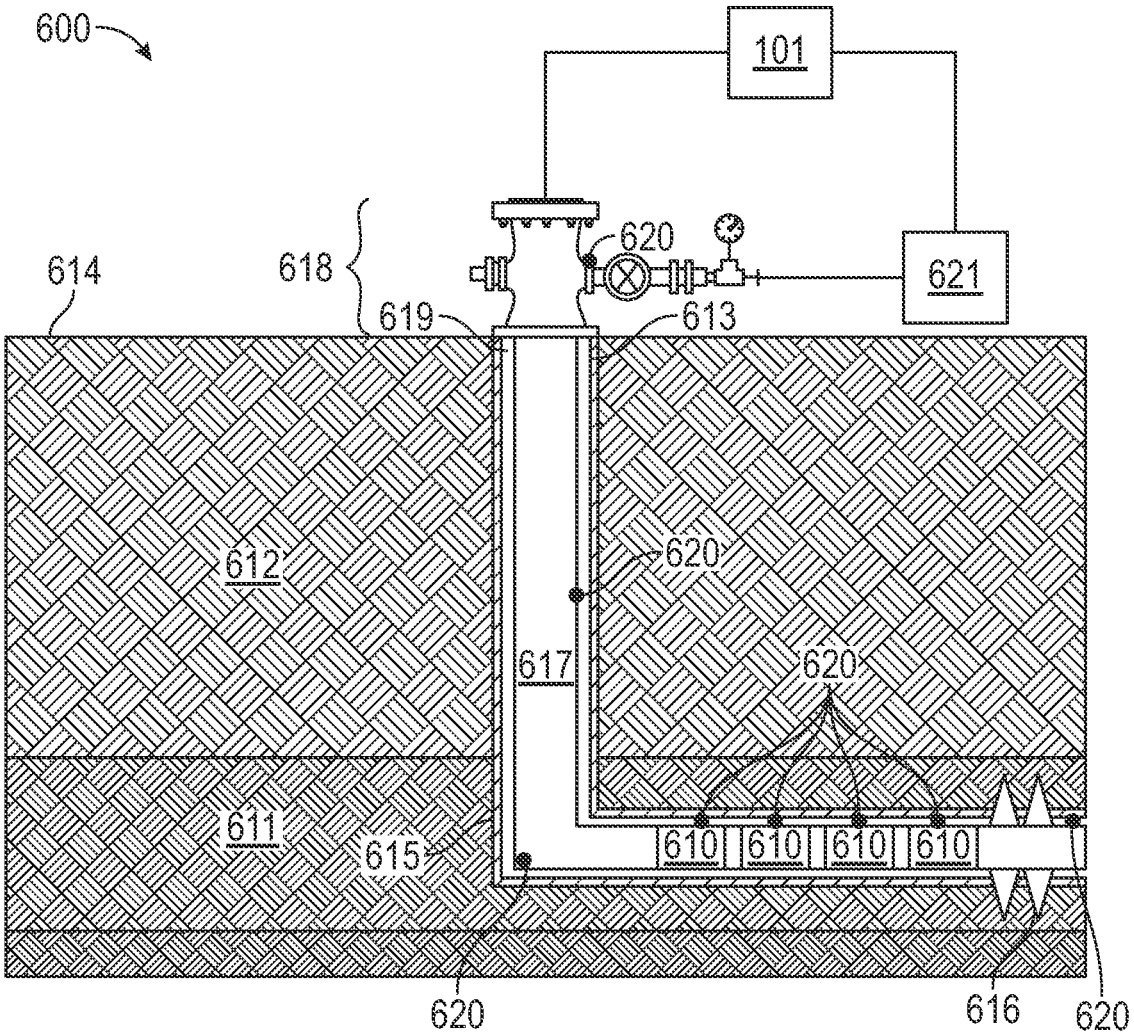
FIG. 6 illustrates a schematic diagram of an injection storage well system using the virtual actuation measuring system of FIG. 1 according to one or more embodiments of the present disclosure.

Turning to FIG. 6, in one or more embodiments, FIG. 6 shows an example of injection operation over the control system 101 of FIG. 1 at an injection storage well site 600. For example, fluids, such as carbon dioxide (CO2) and Hydrogen, from a fluid source 621 may be injected into a reservoir 611 in a formation 612 by drilling a wellbore 613 into the formation 612, establishing a flow path between the reservoir 611 and the wellbore 613, and conveying the fluids from a surface 614 to the reservoir 611 to through the wellbore 613. The fluid source 621 may be a tank, storage unit, reservoir, or any type of storage for holding fluids such as carbon dioxide (CO2) and Hydrogen. Additionally, the wellbore 613 may include a vertical section to reach the reservoir 611 and a horizontal section extending into the reservoir 611. A casing 615 may be installed in the wellbore 613. In some embodiments, the casing 615 may be perforated to have perforations 616 into the reservoir 611 to allow a flow of the injection fluids to enter the wellbore 613.

Typically, an injection tubing string 617 is disposed in the wellbore 613 to carry the fluids from the surface 614 to the reservoir 611. The injection tubing string 617 hangs from a wellhead 618 at the surface 614 and forms an annulus 619 between the production tubing string 617 and the wellbore 613. The production tubing string 617 may extend horizontally into the reservoir 611, thereby forming a flow conduit from the surface 314 to the reservoir 611. Additionally, the fluid source 621 is fluidly coupled to the wellhead 618 to inject the fluids into the injection tubing string 617. In some embodiments, a Christmas tree may be disposed on top of the wellhead 618 for fluid transportation from the fluid source 621.

As fluids are injected from the fluid source 621, the injected fluids flow into the reservoir 611 via the injection tubing string 617. As the injected fluids may contain water, a ratio of fluids for storage (e.g., CO2 or Hydrogen) to water may vary throughout the injection operations. To control an influx of water into the reservoir 611, one or more inflow control devices 610 may be provided in the injection tubing string 617.

In one or more embodiments, sensors 620 are provided on the well equipment throughout the injection storage well site 600. For example, sensors 620 may be provided on the wellhead 618 to measure various pressures, temperatures, flow rates, and fluid properties of the fluid going in the wellbore 613. Sensors are also provided on the injection tubing string 617 to measure various pressures, temperatures, flow rates, and fluid properties of a fluid in a downhole environment both within the injection tubing string 617. Additionally, sensors 620 provided on the one or more inflow control devices 610 may measure various pressures, temperatures, flow rates, and fluid properties of a fluid exiting the injection tubing string 617 and entering the injection tubing string 617. For example, the sensors 620 on the one or more inflow control devices 610 may measure a volume of water in a fluid exiting the injection tubing string 617. Furthermore, sensors 620 provided on the injection tubing string 617 approximate the perforations 616 may measure various pressures, temperatures, flow rates, and fluid properties of a fluid at the bottom of the wellbore 613 and the reservoir 611. The sensors 620 may be pressure sensors, temperature sensors, torque sensors, rotary switches, weight sensors, position sensors, microswitches, hydrophones, accelerometers, etc. In some embodiments, the sensors 620 are miniaturized and wireless.

In one or more embodiments, the sensors 620 are in communication with the control system 101 at the surface 614. As described in FIGS. 1 and 2, the sensors 620 record and transmit various physical properties within the well, such as temperature, pressure, flowrates, or fluid compositional properties to the control system 101. Based on the data from the sensors 620, the control system 101 may adjust various downhole operations to optimize the performance of the injection storage well site 600. For example, each sensor 620 may have an antenna (not shown) to be in communication with the control system 101 to transmit real-time measurements. Further, data acquisition hardware is incorporated into each sensor 620. By obtaining such information, the control system 101 may form a closed loop control and monitoring system without visual inspection and reduce or eliminate human interaction with equipment at the injection storage well site 600.

Still referring to FIG. 6, in one or more embodiments, the injection storage well site 600 is placed in an injection mode to inject the fluids into the reservoir 611. As the injection storage well site 600 is in injection mode, the control system 101 turns on the sensors 620 to take measurements in the wellbore 613. For example, the sensors 620 may measure various pressures, temperatures, flow rates, and fluid properties of a fluid exiting the injection tubing string 617 and entering the reservoir 311. As the sensors 620 acquire data within the wellbore 613, the sensors 620 also transmit in real-time the data to the control system 101. The control system 101 also optimizes data transmission between the sensors 620. For example, data from sensors 620 at a greater depth in the wellbore 613 is sent first to sensors 620 close to the surface 614 before transmission to the control system 101.

In one or more embodiments, the control system 101 will then classify the measured data from each sensor 620 in the wellbore 613. Additionally, the control system 101 classifies a transmission quality between the sensors 620. For example, the control system 101 may cross-correlate the measured data from the sensors 620 with historical data and/or predetermined thresholds (i.e., maximum and minimum pressures, temperatures, flowrates, and fluid properties) uploaded onto the control system 101. Furthermore, the measured data from each sensor 620 may be filtered for noise such that the control system 101 receives clean measured data.

In some embodiments, the control system 101 also may determine the data transmission rate of each sensor 620 to ensure the measured data is transmitted in real-time. Additionally, the control system 101 may adjust the data transmission rate of each sensor 620 to efficiently use power in the corresponding sensors 620. Further, the control system 101 may determine which measured data is selected to minimize measurement uncertainty. It is further envisioned that the control system 101 classifies each sensor 620 with respect to the sensors' 620 operational performance and condition. The control system 101 also sends alerts to replace faulty sensors with new sensors depending on how each sensor 620 is classified.

Based on the collected data, the control system 101 calculates how optimization is conducted for improving injection performance to achieve a determined optimization objective. For example, the control system 101 will determine a required flow rate (e.g., the predetermined production rate) and fluid composition that corresponds to valve state of an inflow control valve (ICV) (103) in the one or more inflow control devices 610. Subsequently, the control system 101 will be able automatically select the required valve state of the ICV (103) associated with a targeted flow rate and fluid composition in real-time. For example, the controller of the control system 101 will command the one or more inflow control devices 610 to actuate the ICV (103) to a valve state per the required targeted flow rate and fluid composition. This allows the ICV (103) to regulate an influx of water within the fluids flowing through the ICV (103). One skilled in the art will appreciate the control system 101 may control and actuate the ICV (103) in the one or more inflow control devices 610 similar to FIGS. 5A and 5B.

Figure 7:
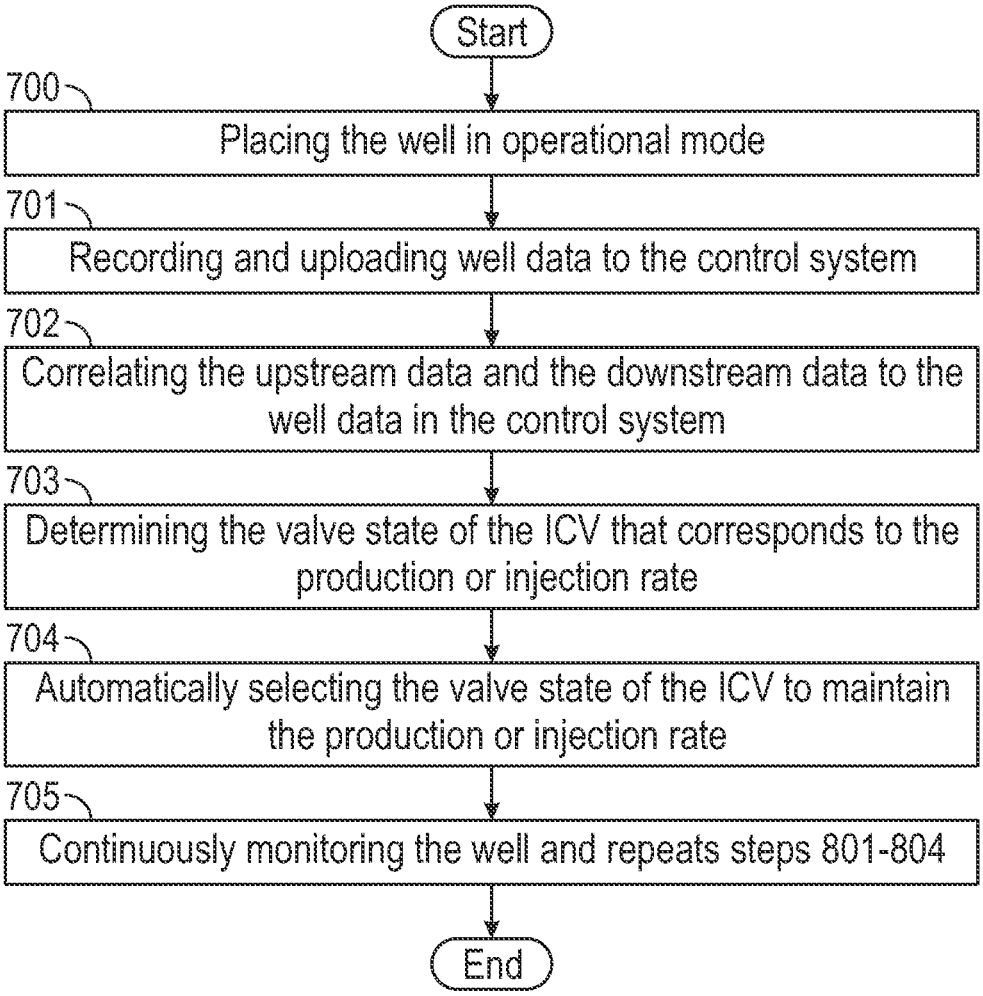
FIG. 7 illustrates a flowchart according to one or more embodiments of the present disclosure.

FIG. 7 is a flowchart showing a method of well operations using the autonomous systems of FIGS. 1-6. One or more blocks in FIG. 7 may be performed by one or more components (e.g., the control system 101 coupled to the controller in communication with the ICV 103) as described in FIGS. 1-6. For example, a non-transitory computer readable medium may store instructions on a memory coupled to a processor such that the instructions include functionality for operating the ICV 103. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Step 700, the well is placed in operational mode. For example, the well may be placed in a production mode to produce fluids from the reservoir. Fluids, such as hydrocarbons, flow out of the reservoir and enter the well via perforations. In the well, the fluids flow upward through the production tubing string to reach the surface via the ICV of the inflow control device. For example, the well fluids flow through the screen of the inflow control device. The screen filters the well fluids from debris and solids. From the screen, the well fluids flow in the space between the screen and the body of inflow control device. In the space, the well fluids flow into a chamber of a housing on the inflow control device. From the chamber, the well fluids flow through the ICV and into the production tubing string. At the surface, the fluids will travel through the wellhead, to the Christmas tree, and into the production storage, transport, or facility via the production flow line. Alternatively, the well may be placed in an injection mode to inject fluids into the reservoir. Fluids, such as CO2 and Hydrogen, flow from a fluid source at the surface and down the wellbore to enter the reservoir via perforations. At the surface, the fluids will travel through the Christmas tree and to the wellhead from the fluid source. From the wellhead, the fluids are injected downward through the injection tubing string to reach the reservoir. In the injection tubing string, the injected fluids flow out of the injection tubing string via the ICV to enter the reservoir for storage.

In Step 701, well data is recorded and uploaded to the control system via sensors. For example, the sensors within the well take various measurements and transmit the data to the control system. Additionally, the control system automatically optimizes data transmission between the sensors.

In Step 702, the control system correlates upstream data and downstream data, relative to the ICV, to the well data. For example, the sensors on the production or injecting tubing string record in real-time the fluid properties and transmit the measurements to the control system to be correlated with associated flow rates in the ICV and other inputted parameters. Additionally, based on the correlation, the control system automatically determines a state (i.e., faulty or not faulty) of the sensors. Further, based on the correlation, the control system automatically evaluates data quality and uncertainty for any errors. It is further envisioned that the control system provides recommendations on replacing the sensors based on the state of the sensors data quality.

In Step 703, the control system determines a valve state of the ICV that corresponds to the required production rate of the well based on the well data. For example, the control system cross-correlates a disc position in the ICV with required production or injection rate by systematically interpolating the well data. The disc of the ICV may be moved to an open or closed position to meet the required production or injection rate. In some embodiments, the valve state may be dependent on a predetermined fluid property range to avoid an influx of water flowing through the ICV.

In Step 704, the control system will automatically adjust the ICV to the required valve state associated with the required production or injection rate in real-time. For example, the controller of the control system will command the ICV to actuate an actuation member to move the disc to an open or closed position that maintains the required production or injection rate. More specifically, the valve state is defined by positioning the disc at the end of the actuation member in the inlet of the ICV. For example, in an open state, the disc spaced away from the inlet and in a closed state, the disc closes the inlet.

In Step 705, the control system continuously monitors the well to evaluate reservoir performance and repeats steps 701-704 until operations are over. For example, the upstream and downstream data will continuously transmit the fluid measurements to the control system for the life of the well such that control system may continuously adjust the valve state of the ICV to maintain the require production or injection rate based on the well data.

In one or more embodiments, the flowchart of FIG. 7 allows for the controller, over the control system, to maintain downhole parameters such that the required production or injection rate is met. With the stored well data and real-time measurements, the controller, over the control system, commands the ICV to actuate the disc to an open or closed position. For example, the actuation member of the ICV is used to move the disc of the ICV from an open to close position, or vice versa, to maintain the downhole parameters at the required production or injection rate. The generated commands from the control system allow the controller to maintain a required downhole parameter by adjusting the valve state (i.e., open or closed) of the ICV. One skilled in the art will appreciate how utilizing the controller coupled to the control system, the autonomous system discloses herein allow for fast and simple ICV adjustments to maintain the required production or injection rate and improve the productivity of the well.

Figure 8:
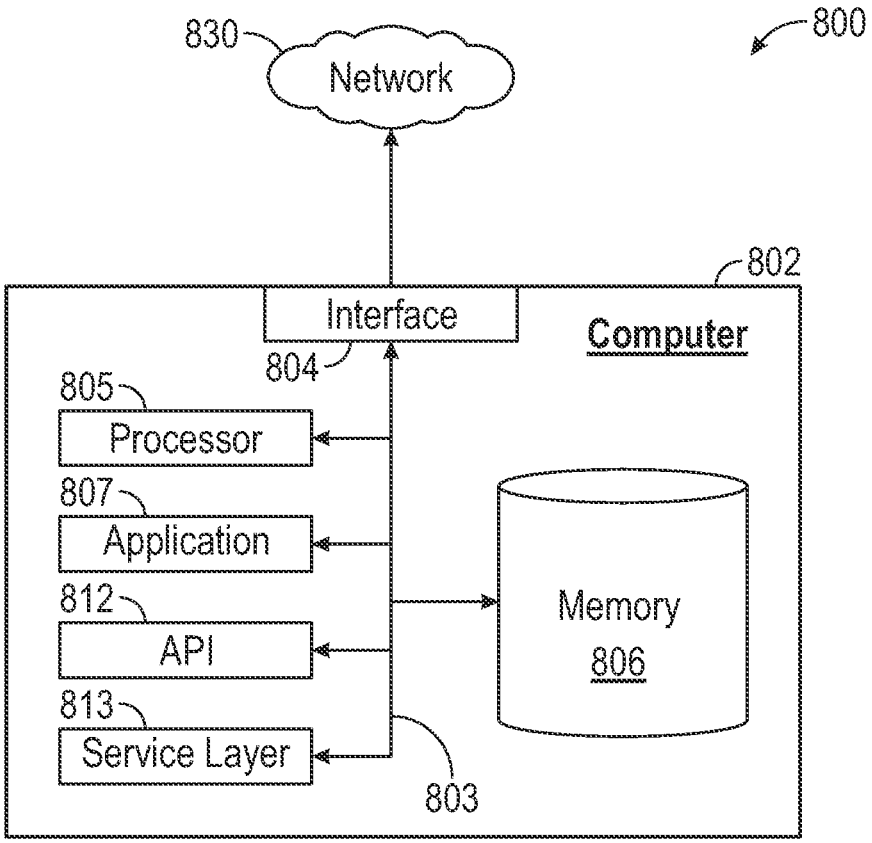
FIG. 8 illustrates a computer system according to one or more embodiments of the present disclosure.

Implementations herein for operating the virtual actuation measuring system may be implemented on a computing system (e.g., the control system) coupled to a controller in communication with the various components at a well site. FIG. 8 is a block diagram of a computer system 800 used to provide computational functionalities associated with described algorithms, methods, functions, processes, flows, and procedures as described in the instant disclosure, according to an implementation. The computer 802 is intended to encompass any computing device such as a high-performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 802 may include a computer that includes an input device, such as a keypad, keyboard, touch screen, or other device that can accept user information, and an output device that conveys information associated with the operation of the computer 802, including digital data, visual, or audio information (or a combination of information), or a GUI.

The computer 802 can serve in a role as a client, network component, a server, a database or other persistency, or any other component (or a combination of roles) of a computer system for performing the subject matter described in the instant disclosure. The computer 802 is communicably coupled with a network 830. In some implementations, one or more components of the computer 802 may be configured to operate within environments, including cloud-computing-based, local, global, or other environment (or a combination of environments).

At a high level, the computer 802 is an electronic computing device operable to receive, transmit, process, store, or manage data and information associated with the described subject matter. According to some implementations, the computer 902 may also include or be communicably coupled with an application server, e-mail server, web server, caching server, streaming data server, business intelligence (BI) server, or other server (or a combination of servers).

The computer 802 can receive requests over network 830 from a client application (for example, executing on another computer 802) and responding to the received requests by processing the said requests in an appropriate software application. In addition, requests may also be sent to the computer 802 from internal users (for example, from a command console or by other appropriate access method), external or third-parties, other automated applications, as well as any other appropriate entities, individuals, systems, or computers.

Each of the components of the computer 802 can communicate using a system bus 803. In some implementations, any or all of the components of the computer 802, both hardware or software (or a combination of hardware and software), may interface with each other or the interface 804 (or a combination of both) over the system bus 803 using an application programming interface (API) 812 or a service layer 813 (or a combination of the API 812 and service layer 813. The API 812 may include specifications for routines, data structures, and object classes. The API 812 may be either computer-language independent or dependent and refer to a complete interface, a single function, or even a set of APIs. The service layer 813 provides software services to the computer 802 or other components (whether or not illustrated) that are communicably coupled to the computer 802. The functionality of the computer 802 may be accessible for all service consumers using this service layer. Software services, such as those provided by the service layer 813, provide reusable, defined business functionalities through a defined interface. For example, the interface may be software written in JAVA, C++, or other suitable language providing data in extensible markup language (XML) format or other suitable format. While illustrated as an integrated component of the computer 802, alternative implementations may illustrate the API 812 or the service layer 813 as stand-alone components in relation to other components of the computer 802 or other components (whether or not illustrated) that are communicably coupled to the computer 802. Moreover, any or all parts of the API 812 or the service layer 813 may be implemented as child or sub-modules of another software module, enterprise application, or hardware module without departing from the scope of this disclosure.

The computer 802 includes an interface 804. Although illustrated as a single interface 804 in FIG. 8, two or more interfaces 804 may be used according to particular needs, desires, or particular implementations of the computer 802. The interface 804 is used by the computer 802 for communicating with other systems in a distributed environment that are connected to the network 830. Generally, the interface 804 includes logic encoded in software or hardware (or a combination of software and hardware) and operable to communicate with the network 830. More specifically, the interface 804 may include software supporting one or more communication protocols associated with communications such that the network 830 or interface's hardware is operable to communicate physical signals within and outside of the computer 802.

The computer 802 includes at least one computer processor 805. Although illustrated as a single computer processor 805 in FIG. 8, two or more processors may be used according to particular needs, desires, or particular implementations of the computer 802. Generally, the computer processor 805 executes instructions and manipulates data to perform the operations of the computer 802 and any algorithms, methods, functions, processes, flows, and procedures as described in the instant disclosure.

The computer 802 also includes a memory 806 that holds data for the computer 802 or other components (or a combination of both) that can be connected to the network 830. For example, the memory 806 can be a database storing data consistent with this disclosure. Although illustrated as a single memory 806 in FIG. 8, two or more memories may be used according to particular needs, desires, or particular implementations of the computer 802 and the described functionality. While the memory 806 is illustrated as an integral component of the computer 802, in alternative implementations, memory 806 can be external to the computer 802.

The application 807 is an algorithmic software engine providing functionality according to particular needs, desires, or particular implementations of the computer 802, particularly with respect to functionality described in this disclosure. For example, the application 807 can serve as one or more components, modules, applications, etc. Further, although illustrated as a single application 807, the application 807 may be implemented as multiple applications 807 on the computer 802. In addition, although illustrated as integral to the computer 802, in alternative implementations, the application 807 can be external to the computer 802.

There may be any number of computers (802) associated with, or external to, a computer system containing the computer 802, each computer (802) communicating over the network 830. Further, the term "client," "user," and other appropriate terminology may be used interchangeably as appropriate without departing from the scope of this disclosure. Moreover, this disclosure contemplates that many users may use one computer (802), or that one user may use multiple computers (802).

In some embodiments, the computer 802 is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

In addition to the benefits described above, the virtual actuation measuring system autonomously controlling the inflow control valve may improve an overall efficiency and performance at the well while reducing cost, well site safety, reduced risk of non-productive time (NPT), and many other advantages. Further, the virtual actuation measuring system may provide further advantages such as enhancing hydrocarbon recovery, optimizing data transmission within the well from sensors in real-time, reducing the need for frequent well testing, and reducing or eliminating human interaction with well equipment to reduce human errors. It is noted that the virtual actuation measuring system may be used for onshore and offshore oil and gas operations to optimize drilling and formation evaluation and improve well productivity (i.e., optimize reservoir performance of hydrocarbon reservoirs, or CO2 storage, or the efficient storing of hydrogen).

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A system, comprising:

a tubing string disposed within a wellbore to be in fluid communication with a reservoir;

one or more inflow control devices provided in the tubing string to receive well fluids produced from the reservoir, wherein the one or more inflow control devices comprises a chamber that is in fluid communication with the tubing string;

an inflow control valve disposed in the chamber of the one or more inflow control devices, wherein the inflow control valve is configured to regulate a flow of the well fluids entering the tubing string based on a ratio of hydrocarbons to water;

a control system coupled to the inflow control valve; and a plurality of sensors on the tubing string and in communication with the control system, wherein the plurality of sensors are wireless miniaturized downhole sensors configured to measure well data within the wellbore, wherein, upon receiving the well data from the plurality of sensors, the control system is configured to:

correlate, in real-time, upstream data and downstream data, relative to the inflow control valve, to the well data to determine a sensor state of each of the plurality of sensors;

optimize, in real-time, a wireless transmission quality of each of the plurality of sensors;

classify, in real-time, each of the plurality of sensors according to the wireless transmission quality of each of the plurality of sensors and the sensor state of each of the plurality of sensors;

optimize, in real-time, data selection based on the classified plurality of sensors to obtain optimized well data;

determine, in real-time, a valve state of the inflow control valve that corresponds to a required production rate of the well by systematically interpolating the optimized well data; and automatically adjust, with a controller coupled to the control system, the inflow control valve to the valve state associated with the required production rate in real-time.

2. The system of claim 1, wherein the well data is a pressure, temperature, flow rate, or a fluid property of a fluid within the well.

3. The system of claim 1, wherein the required production rate comprises a required flow rate and a required fluid composition.

4. The system of claim 1, wherein the valve state comprises an open position and a closed position, wherein in the open position, a disc of the inflow control valve is spaced away from inlet of the inflow control valve, and wherein in the closed position, the disc closes the inlet.

5. The system of claim 1, wherein the largest dimension of each of the plurality of sensors is less than one centimeter.

6. A method, comprising:

placing a well in a production mode to produce fluids from a reservoir;

uploading, in real-time, well data of the well to a control system from a plurality of sensors in the well, wherein the plurality of sensors are miniaturized wireless downhole sensors configured to measure well data;

correlating, in real-time by the control system, upstream data and downstream data, relative to an inflow control valve within the well, to the well data to determine a sensor state of each of the plurality of sensors;

optimizing, in real-time by the control system, a wireless transmission quality of each of the plurality of sensors;

classifying, in real-time by the control system, each of the plurality of sensors according to the wireless transmission quality of each of the plurality of sensors and the sensor state of each of the plurality of sensors;

optimizing, in real-time by the control system, data selection based on the classified plurality of sensors to obtain optimized well data;

determining, in real-time with the control system, a valve state of the inflow control valve that corresponds to a required production rate of the well by systematically interpolating the optimized well data; and automatically adjusting, with a controller coupled to the control system, the inflow control valve to the valve state associated with the required production rate in real-time.

7. The method of claim 6, wherein optimizing the wireless transmission quality of each of the plurality of sensors further comprises:

filtering noise from the well data measured by the plurality of sensors using the control system, and wherein the wireless transmission quality comprises at least one of delay time, service interval, inactivity interval, peak data rate, end-to-end delay throughput, maximum packet loss, and jitter.

8. The method of claim 6, wherein classifying each of the plurality of sensors further comprises:

classifying each of the plurality of sensors based on a signal-to-noise ratio.

9. The method of claim 6, wherein classifying each of the plurality of sensors further comprises:

comparing the well data to a predetermined threshold; and classifying each of the plurality of sensors based on the well data acquired by each of the plurality of sensors passing the predetermined threshold.

10. The method of claim 6, wherein the required production rate comprises a required flow rate and a required fluid composition.

11. The method of claim 6, further comprising sending, with the control system, alerts to replace faulty sensors based on the sensor state of each of the plurality of sensors.

12. The method of claim 6, further comprising continuously adjusting, with the control system, the valve state based on the required production rate.

13. A non-transitory computer readable medium storing instructions on a memory coupled to a processor, the instructions comprising functionality for:

uploading, in real-time, well data of a well to a control system from a plurality of sensors in the well, wherein the plurality of sensors are miniaturized wireless downhole sensors configured to measure well data;

correlating, in real-time by the control system, upstream data and downstream data, relative to an inflow control valve within the well, to the well data to determine a sensor state of each of the plurality of sensors;

optimizing, in real-time by the control system, a wireless transmission quality of each of the plurality of sensors;

classifying, in real-time by the control system, each of the plurality of sensors according to the wireless transmission quality of each of the plurality of sensors and the sensor state of each of the plurality of sensors;

optimizing, in real-time by the control system, data selection based on the classified plurality of sensors to obtain optimized well data;

determining, in real-time with the control system, a valve state of the inflow control valve that corresponds to a required production rate of the well by systematically interpolating the optimized well data; and automatically adjusting, with a controller coupled to the control system, the inflow control valve to the valve state associated with the required production rate in real-time.

14. The non-transitory computer readable medium of claim 13, wherein, during the step of optimizing the wireless transmission quality of each of the plurality of sensors, the instructions further comprise functionality for:

filtering noise from the well data measured by the plurality of sensors using the control system, and wherein the wireless transmission quality comprises at least one of delay time, service interval, inactivity interval, peak data rate, end-to-end delay throughput, maximum packet loss, and jitter.

15. The non-transitory computer readable medium of claim 13, wherein the instructions further comprise functionality for:

sending an alert to replace a faulty sensor if the sensor state indicates a sensor is faulty.

16. The non-transitory computer readable medium of claim 13, wherein the instructions further comprise functionality for:

evaluating a reservoir performance of the well.

17. The non-transitory computer readable medium of claim 13, wherein, during the step of classifying each of the plurality of sensors, the instructions further comprise functionality for:

classifying each of the plurality of sensors based on a signal-to-noise ratio.

18. The non-transitory computer readable medium of claim 13, wherein the instructions further comprise functionality for:

moving a disc of the inflow control valve from an open to close position, or vice versa, corresponding to the valve state.

* * * * *